US010118209B1

(12) United States Patent
Haba et al.

(10) Patent No.: US 10,118,209 B1
(45) Date of Patent: Nov. 6, 2018

(54) VARIABLE PRESSURE DOOR FACADE FORMING

(71) Applicant: Overhead Door Corporation, Lewisville, TX (US)

(72) Inventors: Charles Andrew Haba, Massillon, OH (US); Dwayne Joseph Kornish, Navarre, OH (US); Daniel Christian, McKinney, TX (US); Robert E. Dickerson, Wooster, OH (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 15/615,283

(22) Filed: Jun. 6, 2017

Related U.S. Application Data

(62) Division of application No. 14/199,417, filed on Mar. 6, 2014, now Pat. No. 9,682,411.

(51) Int. Cl.

| | |
|---|---|
| ***B21D 5/08*** | (2006.01) |
| *B21D 17/04* | (2006.01) |
| *B21B 1/22* | (2006.01) |
| *B21H 8/00* | (2006.01) |

(52) U.S. Cl.
CPC ..... *B21D 5/08* (2013.01); *B21B 1/227* (2013.01); *B21B 2263/02* (2013.01); *B21D 17/04* (2013.01); *B21H 8/005* (2013.01)

(58) Field of Classification Search
CPC . B21D 5/08; B21D 5/083; B21D 5/14; B21D 13/04; B21D 13/045; B21D 17/04; B21B 1/227; B21B 27/005; B21B 2263/02; B21H 8/005
USPC ..... 72/176, 180
See application file for complete search history.

(56) References Cited

U.S. PATENT DOCUMENTS

| | | | | |
|---|---|---|---|---|
| 4,543,811 | A | 10/1985 | Aoyama | |
| 5,918,497 | A | 7/1999 | Mieda | |
| 6,261,702 | B1 * | 7/2001 | McGuire | B21B 1/227 428/600 |
| 6,681,612 | B2 | 1/2004 | Matsumoto et al. | |
| 6,705,150 | B1 | 3/2004 | Jella | |
| 8,458,907 | B1 * | 6/2013 | Lowery | B32B 15/046 29/458 |
| 2003/0192281 | A1 * | 10/2003 | Bullinger | B21H 8/00 52/539 |

(Continued)

OTHER PUBLICATIONS

Saeki, Eiichiro et al., "Mechanical Properties of Low Yield Point Steels," Journal of Materials in Civil Engineering, Aug. 1998, pp. 143-152, 10 pages.

*Primary Examiner* — A. Dexter Tugbang
*Assistant Examiner* — Joshua D Anderson
(74) *Attorney, Agent, or Firm* — Foley & Lardner LLP

(57) ABSTRACT

This disclosure presents methods and/or processes for forming a garage door façade using variable pressure. The forming processes, different from common stamping processes, creates a shaded design in a garage door section such that a continuous pattern is realized in the length direction (i.e., the longest side of the garage door section). The forming processes also produces significantly deep and smooth impressions that deform the center of the design. The forming process may be preceded by a texturing process, for example, each garage door section may first be textured and then sent for forming the design.

19 Claims, 5 Drawing Sheets

(56) References Cited

U.S. PATENT DOCUMENTS

| | | | | |
|---|---|---|---|---|
| 2005/0092447 | A1* | 5/2005 | Mock | E06B 3/485<br>160/201 |
| 2015/0266070 | A1* | 9/2015 | Schneider | B21D 5/08<br>312/334.1 |

* cited by examiner

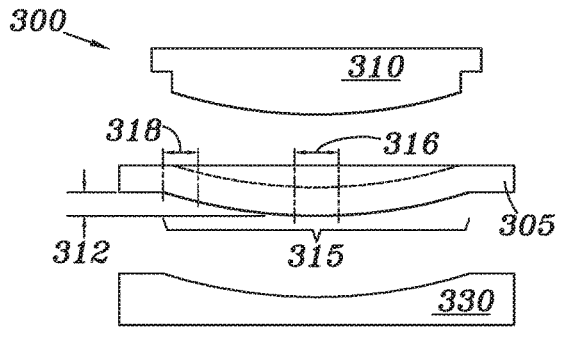
FIG. 3A
FIG. 3B
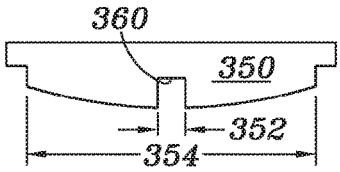
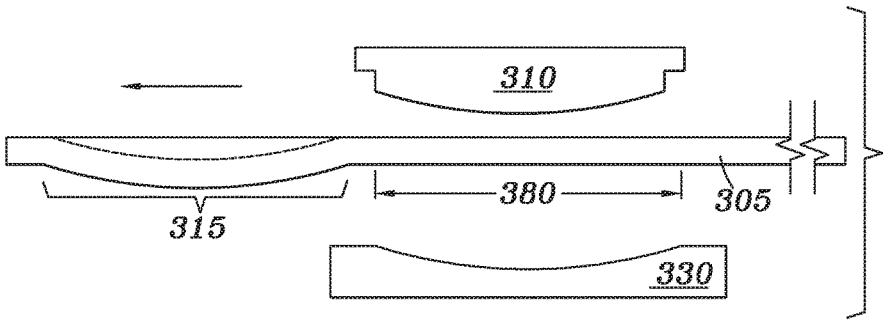
FIG. 3C
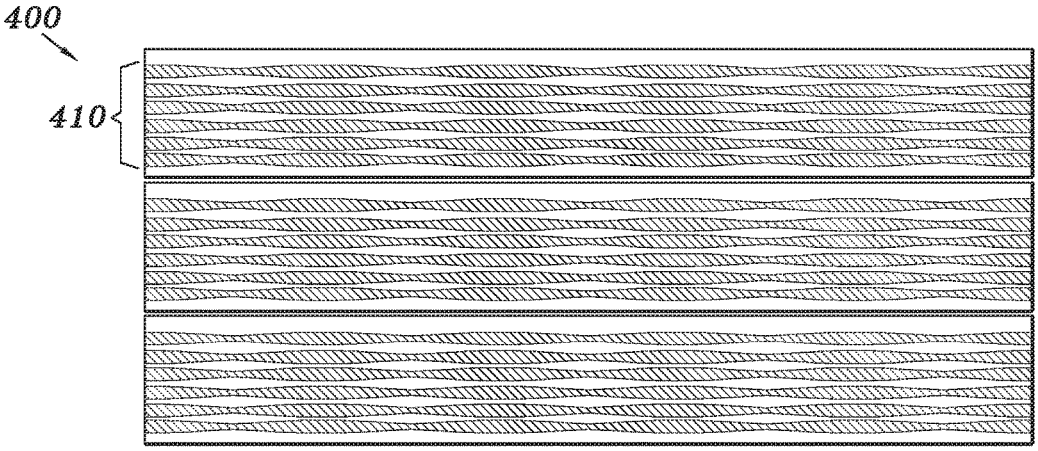
FIG. 4

VARIABLE PRESSURE DOOR FACADE FORMING

CROSS REFERENCE TO RELATED APPLICATIONS

This application is a divisional of U.S. patent application Ser. No. 14/199,417, filed Mar. 6, 2014, pending, and is incorporated herein by reference in its entirety.

TECHNICAL FIELD

This disclosure relates to garage door manufacturing, and in particular, to forming garage door façade designs.

BACKGROUND

Garage doors facades are formed into various design shapes for improved visibility and aesthetics. In order to be noticed from substantial distances (e.g., 10 m or 30 ft), the facades typically have a depth variation greater than about 1.3 mm (0.05 in). Garage doors may also be featured with textures such as wood grain, stucco, etc. The textures may be applied onto different designs to provide a materialistic look when the garage door is viewed closely.

Because of various limitations the result from the manufacture of metal garage doors, façade designs are somewhat limited. For example, traditional metal garage door façade designs typically include a frame or series of frames stamped onto a metal sheet (e.g., each garage door section). The frame defines a perimeter to form a rectangular or square framed design. The frame provides embossed depth variation that produces a visual perception of a raised panel, even though only the frame's perimeter has been deformed. In particular, when the frame is stamped onto the garage door section, the center of the design frame is often left undeformed. However, with respect to other façade designs, such as, for example, designs that include variable and/or "faded" patterns extending along the length of the door, there is a need to accommodate the manufacture of such designs.

SUMMARY

According to a first embodiment, there is provided a method for producing a design in a garage door section. The method includes receiving the garage door section at a pair of roller dies, the garage door section having a width and a length, the width being shorter than the length. The method further includes feeding the garage door section into the pair of roller dies along the length and rotating the pair of roller dies so as to vary the pressure against the garage door section to form a significantly deep out-of-plane deformation in the garage door section.

In certain embodiments, the significantly deep out-of-plane deformation is about at least 1.5 mm (0.06 in).

In yet other embodiments, the significantly deep out-of-plane deformation is about 3.175 mm (0.125 in).

In other embodiments, the feeding the garage door section into the pair of roller dies comprises feeding at a rate between about 10 m/min (30 ft/min) and 20 m/min (60 ft/min).

In other certain embodiments, the method further includes pre-texturing the garage door section using a pair of texturing roller dies.

In yet another embodiment, the pair of texturing roller dies produces a texture of depth between about 0.5 mm (0.02 in) and 1 mm (0.04 in)

In still another embodiment, the garage door section is pre-textured with a stucco texture.

In other certain embodiments, the design expands substantially entirely across the length of the garage door section.

In yet another embodiment, the garage door section comprises a steel sheet having a low ultimate tensile strength.

In other embodiments, the garage door section comprises a steel sheet having an ultimate tensile strength from approximately 172.4 MPa (25 ksi) to 275.8 MPa (40 ksi).

In a second aspect, there is provided a method for producing a design in a garage door section. The method includes providing a continuously curved stamping die, affixing the garage door section onto a bed press, and pressing the stamping die onto the garage door section to form a depth variation section having a deep draw portion and a depth variation portion, the depth variation portion providing a continuous smooth transition with the garage door section.

According to some embodiments, the continuously curved stamping die has a crescent shaped cross section having a convex profile for generating the depth variation section.

In yet other embodiments, the bed press includes a female mold corresponding in shape with the crescent shaped cross section of the continuously curved stamping die.

In still other embodiments, the crescent shaped cross section further includes a central recess having a width substantially smaller than a total width of the crescent shaped cross section.

In yet another embodiment, the width of the central recess is less than about 25% of the total width of the crescent shaped cross section.

In other certain embodiments, the width of the central recess is less than about 15% of the total width of the crescent shaped cross section.

In other embodiments, the width of the central recess is less than about 10% of the total width of the crescent shaped cross section.

In still other embodiments, the method further includes releasing the garage door section off the bed press, translating the garage door section for exposing a next blank area to the stamping die and affixing the garage door section onto the bed press. The method also includes pressing the stamping die onto the next blank area to form a second depth variation section having the deep draw portion and the depth variation portion.

In yet another embodiment, the deep draw portion is about 9.5 mm (⅜ in) deep into the garage door section.

In still other embodiments, the depth variation portion includes a predefined radius.

Other aspects, features, and advantages will become apparent from the following detailed description when taken in conjunction with the accompanying drawings, which are part of this disclosure and which illustrate, by way of example, principles of the disclosure.

DESCRIPTION OF THE FIGURES

FIG. 3A is a schematic side view of a press forming process for forming a design onto a garage door section.

FIG. 3B is a schematic side view of a crescent shaped stamping die having a central recess.

FIG. 3C is a schematic side view of a stamping process for forming multiple designs onto a garage door section FIG. 4 is a front view of an example garage door design made with the roll forming process illustrated in FIG. 2.

DETAILED DESCRIPTION

A sectional garage door includes multiple garage door sections divided horizontally, each typically including a particular facade design and/or texture. A design can include variations in shape to generate a depth perception when the garage door is viewed from afar (e.g., 10 m or 30 ft). A texture is a shallow imprint for forming a simulated look to a particular material. For example, a design can include an array of frames embossed onto a garage door section and a texture can include details of wood grain, stucco, or other patterns. According to some embodiments, textures have a depth variation between 0.5 mm (0.02 in) and 1 mm (0.04 in) and are less perceptible afar. Common designs include simulate raised panel designs, which embosses a uniform depth panel frame in the garage door section and produces a perception of a raised panel without raising the center portion of the panel frame in the garage door section.

This disclosure presents methods and/or processes for forming a garage door façade using variable pressure. The forming processes, which are different from traditional stamping processes, create a shaded design in a garage door section such that a continuous pattern is realized in the length direction (i.e., the longest side of the garage door section). The forming processes also produce significantly deep and smooth impressions that deform the center portion or area of the design. In some embodiments, the forming process is preceded by a texturing process prior to forming the design in the garage door panel. Details of the forming process are described below.

Figure 1A:
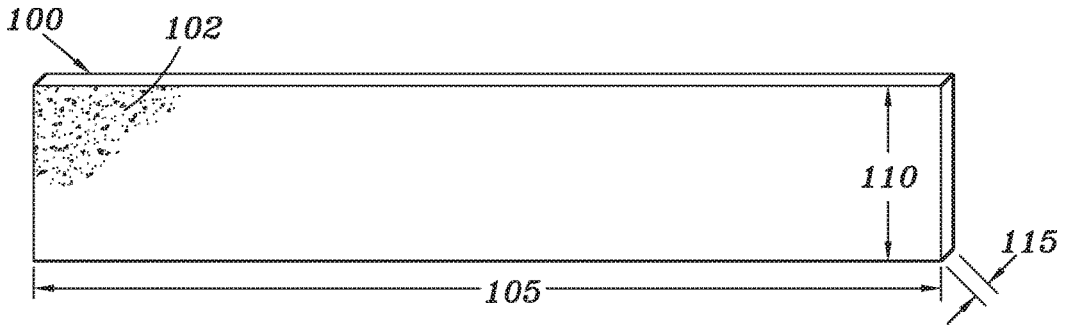
FIG. 1A is a perspective view of a blank garage door section without any design.

FIG. 1A illustrates a perspective view of a garage door section 100 without any design formed thereon. In FIG. 1A, the garage door section 100 is rectangular and has a length 105, a width 110, and a thickness 115. The length 105 is substantially longer than the width 110. In some embodiments, a texture 102 may first be applied onto the garage door section 100; however, it should be understood that the texture may be applied at any point in time during the manufacturing process. In some embodiments, the texture 102 is formed of a depth between about 0.5 mm and 1 mm, which is substantially smaller than the thickness 115 (e.g., 25 mm or 1 inch) of the garage door section 100.

Figure 1B:
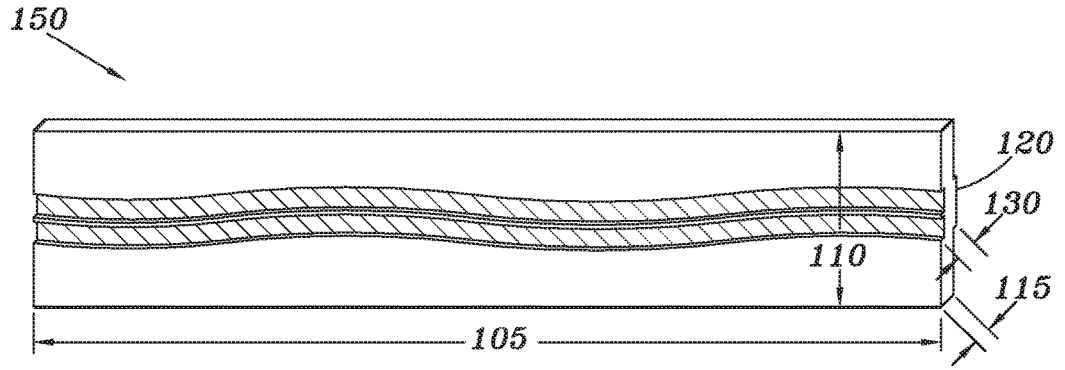
FIG. 1B is a perspective view of a garage door section with a roll formed design.

Referring specifically to FIG. 1B, a perspective view of a roll formed garage door section 150 is illustrated. In the embodiment illustrated in FIG. 1B, the roll formed garage door section 150 is made from the blank garage door section 100 using a roll forming process. For example, a pair of rollers form a design 120 into the garage door section 100 to produce the roll formed garage door section 150. As described in greater detail below, the design 120 includes a depth 130, which is significantly greater than the depth of the texture 102 and the thickness 115 of the garage door section 150.

Figure 2:
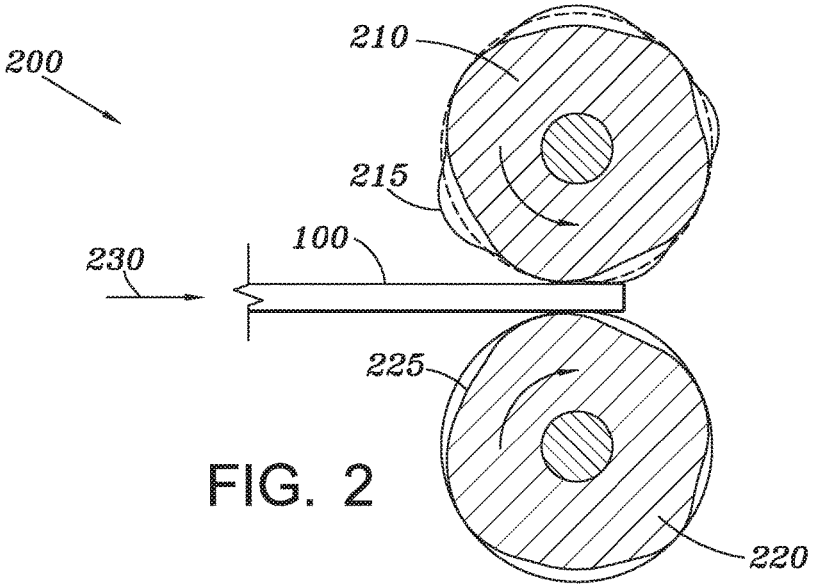
FIG. 2 is a schematic side view of a roll forming process for making the roll formed garage door section.

FIG. 2 is a schematic side view of a roll forming process 200 for making the roll formed garage door section 150. A blank garage door section 100 is fed into and between a pair of roller dies 210 and 220 along the length 105 at a particular feed rate in the direction of arrow 230. The feed rate is between about 10 m/min and 20 m/min. In the embodiment illustrated in FIG. 2, the roller die 210 includes embossing patterns 215 extending therefrom for the to-be-formed design 120. The roller die 220 further includes recessed patterns 225 for the to-be-formed design 120. The design 120 extends substantially entirely along the length 105 of the garage door section 100.

In the forming process, the pair of roller dies 210 and 220 rotate in opposite directions to move the garage door section 100 in the direction of arrow 230 and form a significantly deep out-of-plane deformation to form the design 120 in the garage door section 100. The significantly deep out of plane deformation is at least about 1.5 mm (0.06 in) in depth, for example, commonly about 3.175 mm (0.125 in) in depth. In order to create the design with such significantly deep out of plane deformation, the garage door section 100 is formed from a steel sheet having a low ultimate tensile strength. For example, the yield tensile strength of the steel sheet is not greater than about 172.4 MPa (25 ksi). In other instances, the yield tensile strength of the steel sheet ranges from 172.4 MPa (25 ksi) to 275.8 MPa (40 ksi).

In some embodiments, the garage door section 100 is pre-textured with, for example, a stucco type texture 102. According to one method, the garage door section 100 is first roll formed with a first pair of roller dies embossing the stucco texture 102 onto the garage door section 100. The stucco texture 102 is formed having a depth variation between about 0.5 mm (0.02 in) and 1 mm (0.04 in). In other instances, the garage door section 100 can be pre-textured with a wood grain texture, or another suitable texture.

Figure 5A:
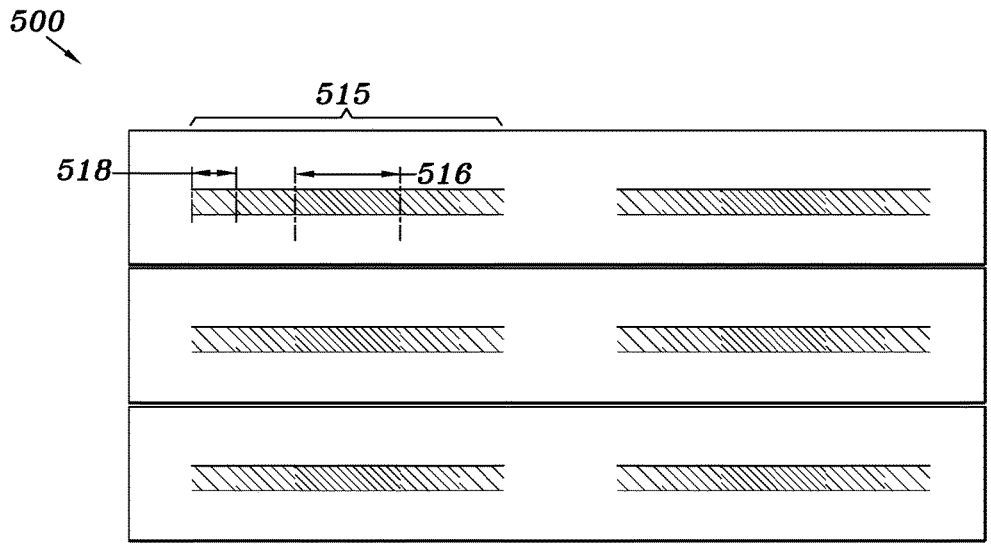
FIGS. 5A and 5B are front views of example garage door designs made with the press forming process illustrated in FIG. 3.
Figure 6A:
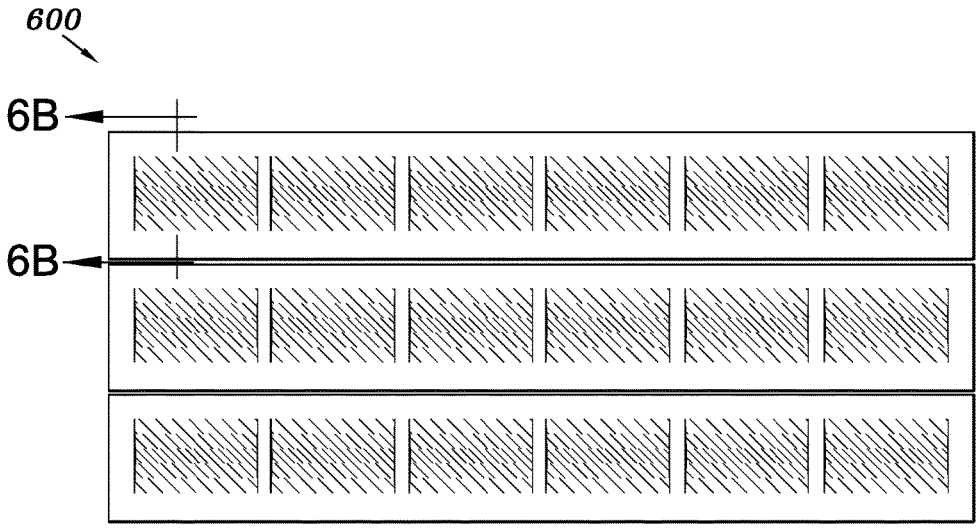
FIGS. 6A and 6B are views of another example of a design created by a stamping process similar to that of FIG. 3C.

Referring now to FIG. 3A, a schematic side view of a press forming process for forming a design 315 onto the blank garage door section 100 is illustrated to form a stamped garage door section 305. In FIG. 3A, a continuously curved stamping die 310 and a bed press 330 are used for producing the continuously curved design 315 in the stamped garage door section 305. The continuously curved design 315 may be aligned to the garage door section in the length direction, as shown in FIG. 5A, or in the width direction, as shown in FIG. 6A. According to embodiments disclosed herein, the depth of the continuously curved stamping die 310 is dictated based on particular design needs. During manufacture, the blank garage door section 100 is first affixed onto the bed press 330. The stamping die 310 is then pressed onto the blank garage door section 100 to form a depth variation section of the continuously curved design 315. In FIG. 3A, the depth variation section has a deep draw portion 316 and a depth variation portion 318.

In the embodiment illustrated in FIG. 3A, the deep draw portion 316 includes a deep out of the plane deformation at the center of the continuously curved design 315. The deep out of plane deformation is about 9.5 mm (⅜ in) deep into the stamped garage door section 305. The depth variation section 318 provides a continuously smooth transition with the rest of the undeformed portion of the stamped garage door section 305. In some implementations, the depth variation section 318 has a predefined radius.

As illustrated in FIG. 3A, the continuously curved stamping die 310 is formed of a crescent shaped cross section. The cross section has a convex profile for generating the depth variation section 318 in the continuously curved design 315. In some embodiments, the bed press 330 includes a female mold complying with the quarter crescent shaped cross section of the continuously curved stamping die 310.

In the embodiment illustrated in FIG. 3B, the stamping die 350 includes a central recess 360. The central recess 360 is formed having a width 352 substantially smaller than the total width 354 of the cross section of the stamping die 350. For example, in some embodiments, the width of the central recess 352 is less than about 25% of the total width 354 of the cross section of the stamping die 350. In some embodiments, the width of the central recess 352 is less than about 15% of the total width 354 of the cross section of the stamping die 350. In other embodiments, the width of the central recess 352 is less than about 10% of the total width 354 of the cross section of the stamping dies 350. One example design produced by the crescent shaped stamping die 350 is illustrated in FIG. 5B.

FIG. 3C is a schematic side view of a stamping process for forming multiple designs 315 onto a blank garage door section 100. For example, the stamping process of FIG. 3C is a continuation step preceded by the stamping process shown in FIG. 3A. After a first design 315 is formed onto the blank garage door section 100, the garage door section 305 is released from the bed press 330. The garage door section 305 is then translated sideways for exposing a next blank area 380 to the stamping die 310. The stamping die 310 then presses onto the blank area 380 to form a second depth variation section that has the deep draw portion 316 and the depth variation portion 318.

FIG. 4 is a front view of an example garage door 400 having a design 410 made with the roll forming process illustrated in FIG. 2. The design 410 includes a significantly deep out-of-plane deformation of about 3.175 mm. The design 410 expands substantially entirely across the length of the garage door 400. In some embodiments, the design 410 includes multiple continuous and consistent repetitions of a design pattern created by a pair of roller dies. In some embodiments, the garage door 400 is textured with a stucco texture, a wood grain texture, or the like.

Figure 5B:
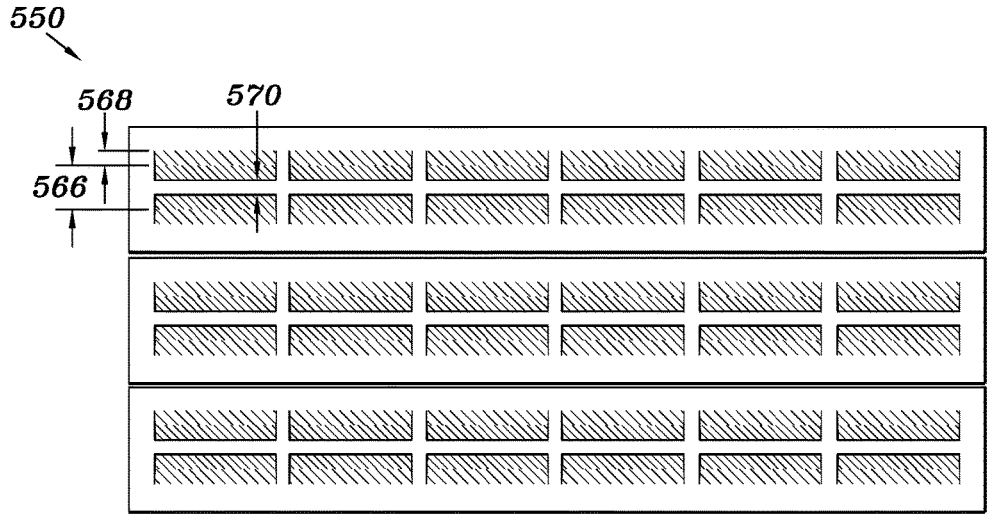

FIGS. 5A and 5B are front views of exemplary garage door façade designs made with the press forming process illustrated in FIG. 3. Referring to FIG. 5A, for example, a garage door 500 has a façade design 515 that is formed by a crescent shaped stamping die aligned in the length direction of the garage door section. The design 515 includes a deep draw portion 516 and a depth variation portion 518, similar to the deep draw portion 316 and the depth variation portion 318 of the continuously curved design 315. Multiple design patterns 515 are applied onto the garage door 500. Referring specifically to FIG. 5B, a garage door 550 includes a facade design pattern that is formed by the crescent shaped stamping die having a central recess, such as the stamping die 350 illustrated in FIG. 3B. The stamping die 350 is aligned in the width direction of the garage door section. The crescent shaped stamping die 350 includes a central recess that creates a design having a deep draw portion 566 and the depth variation portion 568. The deep draw portion 566 has a raised portion 570 corresponding to the central recess in the half moon stamping die.

Figure 6B:
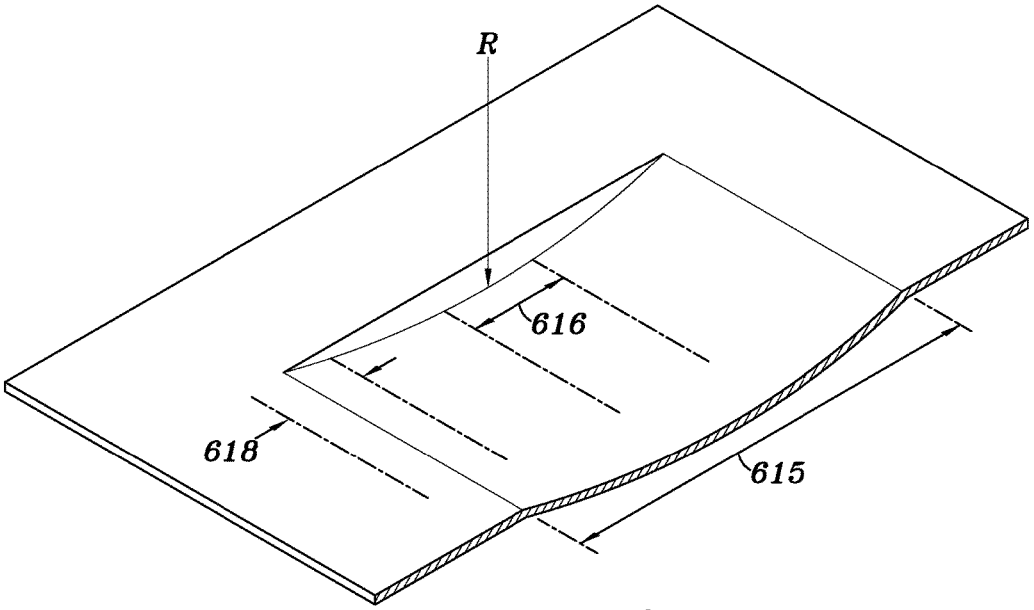

FIGS. 6A and 6B are views of another example of a façade design 600 created by a stamping process similar to that of FIG. 3C. FIG. 6A is a front view and FIG. 6B is a detailed perspective cross-sectional view. According to some embodiments, the design 600 is formed by the stamping process 300 illustrated in FIG. 3A, wherein the stamping die 310 is aligned with the width direction of the garage door section. Therefore each stamping shape 615 includes a deep draw portion 616 and a depth variation portion 618. If the stamping die 350 of FIG. 3B is used, the stamping process would create the design 550 as illustrated in FIG. 5B.

Figure 7:
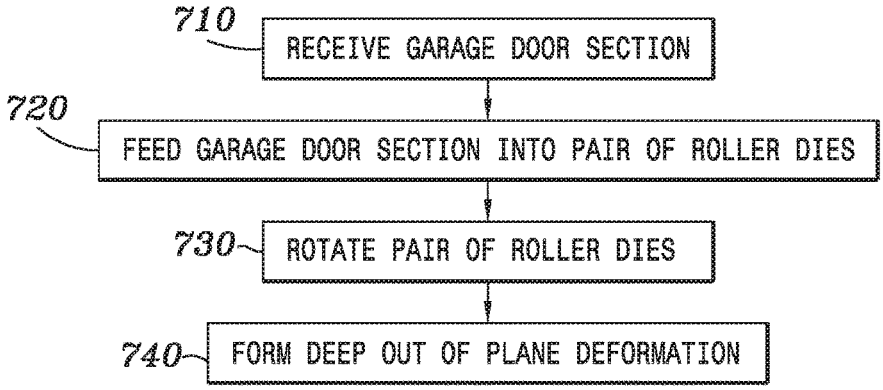
FIG. 7 is a flowchart illustrating a roll forming process for creating a design in a garage door section.

FIG. 7 is a flowchart illustrating a roll forming process for creating a façade design in a garage door section. At 710, a blank garage door section is received at a pair of roller dies. The blank garage door section has a width and a length. The length is longer than the width. In some embodiments, the blank garage door section is pre-textured by a pair of texturing roller dies. For example, the texture can be a stucco texture, a wood grain texture, or the like. The depth of the texture may be between 0.5 mm and 1 mm.

At block 720, the blank garage door section is fed into the pair of roller dies along the length. In some embodiments, the blank garage door section is fed into the pair of roller dies at the rate between about 10 m/min and 20 m/min. Preferably, the blank garage door section may is formed of a steel sheet having a low ultimate tensile strength for being roll formed in the pair of roller dies. In some implementations, the yield tensile strength is not greater than about 172.4 MPa (25 ksi). In other implementations, the yield tensile strength is between approximately 172.4 MPa (25 ksi) and 275.8 MPa (40 ksi).

At block 730, the pair of roller dies rotates to draw in and roll form the garage door section. In some embodiments, the pair of roller dies respectively include an embossing portion and a recess for applying a variable pressure to form the design onto the garage door section.

At block 740, the pair of roller dies forms a significantly deep out of plane deformation in the garage door section. The significantly deep out of plane deformation is about at least 1.5 mm. For example, the deep out of plane deformation can be about 3.175 mm.

Figure 8:
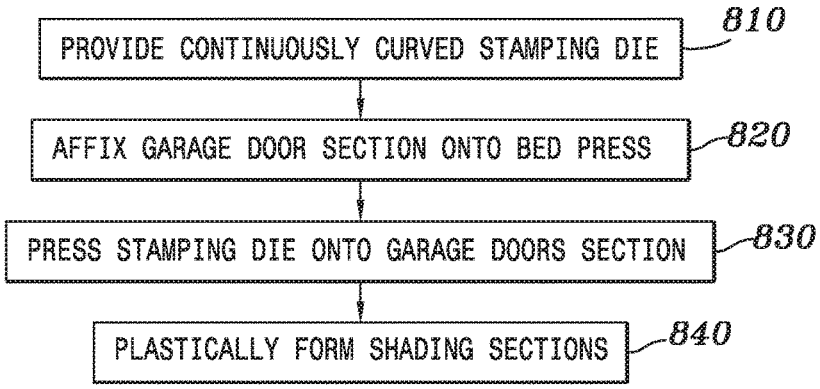
FIG. 8 is a flowchart illustrating a press forming process for creating a design in a garage door section.

FIG. 8 is a flowchart illustrating a press forming process for creating a façade design in a garage door section. At block 810, a continuously curved stamping die is provided. In some implementations, the continuously curved stamping die has a crescent shaped cross section that has a convex profile for generating a depth variation section in the garage door section.

At block 820, the garage door section is affixed onto a bed press. The bed press includes a female mold corresponding to the crescent shaped cross section of the continuously curved stamping die. In some embodiments, the crescent shaped cross section further includes a central recess having a width substantially smaller than a total width of the crescent shaped cross section. The central recess may form a raised section into the depth variation section. For example, the width of central recess may be less than about 25% of the total width of the crescent shaped cross section. In some implementations, the width of the central recess is be less than about 15% of the total width of the crescent shaped cross section. In some implementations, the width of the central recess is be less than about 10% of the total width of the crescent shaped cross section.

At block 830, the stamping die is pressed onto the garage door section to form one or more depth variation sections. Each depth variation section includes a deep draw portion and a depth variation portion. According to some embodiments, the deep draw portion is about 9.5 mm deep into the garage door section. The depth variation portion may have a predefined radius and provide a continuously smooth transition with the rest of the undeformed garage door section.

At block 840, one or more depth variation sections are formed plastically in the garage door section. For example, a first depth variation section is formed in the garage door section. The garage door section is then be released off the bed press and translated for exposing a next blank area to the stamping die. The translated garage door section is then affixed onto the bed press again. The stamping die is pressed onto the next blank area to form a second depth variation section which has the deep draw portion and the depth variation portion as the first depth variation section. Subsequence depth variation sections maybe produced in a similar manner.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but on the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A method for producing a design in a garage door section, the method comprising:

receiving the garage door section at a pair of roller dies, the garage door section having a thickness and a width and a length, the width being shorter than the length;

feeding the garage door section into the pair of roller dies along the length in a length direction; and rotating the pair of roller dies such that corresponding embossing patterns and recessed patterns of the pair of roller dies apply a variable pressure against the garage door section to form a deep out-of-plane deformation into the thickness of the garage door section and extending along the length of the garage door section, wherein a shape of the corresponding embossing patterns and recessed patterns of the pair of roller dies forms the deep out-of-plane deformation including a varying width perpendicular to the length direction and a depth of the out-of-plane deformation in a direction of the thickness of the garage door section is at least greater than the garage door section thickness.

2. The method of claim 1, wherein the depth of the deep out-of-plane deformation is at least 1.5 mm (0.06 in).

3. The method of claim 1, wherein the depth of the deep out-of-plane deformation is 3.175 mm (0.125 in).

4. The method of claim 1, wherein forming the deep out-of-plane deformation further comprises forming a plurality of areas of deep out-of-plane deformation, wherein the plurality areas having different depths including 1.5 mm (0.06 in) and 3.175 mm (0.125 in).

5. The method of claim 1, wherein feeding the garage door section into the pair of roller dies comprises feeding at a rate between 10 m/min (30 ft/min) and 20 m/min (60 ft/min).

6. The method of claim 1, further comprising pre-texturing the garage door section using a pair of texturing roller dies.

7. The method of claim 6, wherein the pair of texturing roller dies produces a texture of depth between 0.5 mm (0.02 in) and 1 mm (0.04 in).

8. The method of claim 1, wherein the garage door section is pre-textured with a stucco or faux woodgrain texture.

9. The method of claim 1, wherein the design in the garage door section expands substantially entirely across the length of the garage door section.

10. The method of claim 1, wherein the garage door section comprises a steel sheet having a low yield tensile strength.

11. A method for producing a design in a garage door section, the method comprising:

providing the garage door section having a thickness and a width and a length, the width being shorter than the length;

providing a pair of roller dies;

aligning the garage door section between the pair of roller dies;

rotating the pair of roller dies to draw in the garage door section along the length in a length direction; and while rotating the pair of roller dies, corresponding embossing patterns and recessed patterns of the pair or roller apply a variable pressure against the garage door section to form a deep out-of-plane deformation into the thickness of the garage door section and extending along the length of the garage door section wherein a shape of the corresponding embossing patterns and recessed patterns of the pair of roller dies forms the deep out-of-plane deformation including a varying width perpendicular to the length direction and a depth of the deep out-of-plane deformation in a direction of the thickness of the garage door section is at least greater than the garage door section thickness.

12. The method of claim 11, wherein rotating the pair of rollers to draw in the garage door section comprises drawing in the garage door section along the garage door section length.

13. The method of claim 11, wherein providing the pair of roller dies comprises providing two roller dies, one roller die having the embossing patterns and the other roller die having the recess patterns corresponding to the embossing patterns.

14. The method of claim 11, wherein rotating the pair of roller dies comprises rotating the dies in opposite directions.

15. The method of claim 11, wherein drawing in the garage door section into the pair of roller dies comprises drawing in at a rate between 10 m/min (30 ft/min) and 20 m/min (60 ft/min).

16. The method of claim 11, further comprising pre-texturing the garage door section using a pair of texturing roller dies.

17. The method of claim 11, wherein forming the deep out-of-plane deformation comprises forming an out-of-plane portion at a depth of at least 1.5 mm (0.06 in).

18. The method of claim 11, wherein forming the deep out-of-plane deformation comprises forming an out-of-plane portion at a depth of 3.175 mm (0.125 in).

19. The method of claim 11, wherein providing the garage door section comprises providing the garage door section formed of a steel sheet having a low yield tensile strength.

* * * * *